US007510126B2

(12) United States Patent
Rossi et al.

(10) Patent No.: US 7,510,126 B2
(45) Date of Patent: Mar. 31, 2009

(54) HVAC COMMUNICATION SYSTEM

(75) Inventors: John F. Rossi, Mendham, NJ (US); Paul Michael Huddleston, Sandy Springs, GA (US); Mark Lee Barton, Lilburn, GA (US); Bradley A. Smith, Buford, GA (US); Howard Ng, Towaco, NJ (US); Carl J. Mueller, St. Louis, MO (US); James P. Garozzo, St. Louis, MO (US); Cecil H. Barrett, Lawrenceville, GA (US); Russell Thomas House, Ball Ground, GA (US)

(73) Assignee: Comverge, Inc., Norcross, GA (US)

( * ) Notice: Subject to any disclaimer, the term of this patent is extended or adjusted under 35 U.S.C. 154(b) by 292 days.

(21) Appl. No.: 11/567,626

(22) Filed: Dec. 6, 2006

(65) Prior Publication Data

US 2007/0131786 A1 Jun. 14, 2007

Related U.S. Application Data

(62) Division of application No. 11/301,447, filed on Dec. 13, 2005, now Pat. No. 7,163,158.

(51) Int. Cl.

| | |
|---|---|
| ***G05D 23/00*** | (2006.01) |
| ***G05B 11/01*** | (2006.01) |
| ***G08B 1/08*** | (2006.01) |
| ***H04M 11/04*** | (2006.01) |

(52) U.S. Cl. ..... 236/51; 340/310.17; 340/538; 340/538.16

(58) Field of Classification Search ..... 236/51, 236/1 C; 340/310, 310.17, 533, 538, 538.11, 340/538.16

See application file for complete search history.

(56) References Cited

U.S. PATENT DOCUMENTS

| | | | |
|---|---|---|---|
| 4,347,974 | A | 9/1982 | Pinckaers et al. |
| 4,387,763 | A | 6/1983 | Benton |
| 4,753,388 | A | 6/1988 | Rummage |
| 5,133,302 | A | 7/1992 | Yamada et al. |
| 5,816,491 | A | 10/1998 | Berkeley et al. |
| 6,622,926 | B1 | 9/2003 | Sartain et al. |
| 6,718,213 | B1 | 4/2004 | Enberg |
| 7,062,361 | B1 | 6/2006 | Lane |
| 7,130,719 | B2 | 10/2006 | Ehlers et al. |
| 7,163,158 | B2 | 1/2007 | Rossi et al. |
| 2006/0036350 | A1 | 2/2006 | Bohrer et al. |

FOREIGN PATENT DOCUMENTS

| | | | |
|---|---|---|---|
| JP | 2003262387 | A | 9/2003 |

*Primary Examiner*—Chen-Wen Jiang
(74) *Attorney, Agent, or Firm*—Philip H. Burrus, IV

(57) ABSTRACT

A system for communicating across conventional HVAC wiring is provided. The system includes a communication device having a communication module capable of inducing low power, high frequency current signals into a single control wire coupling, for example, a thermostat with a compressor. The communication module includes a power supply module that draws power sufficient to operate the communication module from the existing HVAC wiring, so as to eliminate any need for batteries or external power sources. A second communication module may be coupled to the single control wire. The second communication module operates as a transceiver sending communication signals to, and receiving communication signals from, the communication module. In one embodiment, the communication module is disposed within a building, for example coupled to an electronic thermostat, while the second communication module is disposed outside the building near the compressor. The communication signals are RF modulated signals between 5 and 50 MHz so as to take advantage of and pass across parasitic capacitances found inherent in transformers or other coils disposed within HVAC loads.

5 Claims, 5 Drawing Sheets

HVAC COMMUNICATION SYSTEM

CROSS REFERENCE TO PRIOR APPLICATIONS

This application is a divisional application claiming priority from U.S. application Ser. No. 11/301,447, filed Dec. 13, 2005, now U.S. Pat. No. 7,163,158 entitled "HVAC Communication System."

BACKGROUND

1. Technical Field

This invention relates generally to a communication system for a single-wire interface, and more particularly to a communication system capable of communicating between, for example, a thermostat and a receiving unit disposed near or in an air compressor by way of high frequency current modulation along a single HVAC control wire.

2. Background Art

As the cost of energy continues to rise, heating and cooling a home has become a complicated activity. When natural gas, heating oil and electric power were plentiful and inexpensive, one may simply have set the thermostat on 78 in the summer and 68 in the winter to adequately heat and cool a house. Under such a plan, they may only touch the thermostat twice in a year.

With the advent of new technology, combined with rising energy costs, it is often financially advantageous to become a more active participant in the heating and cooling of the home. For instance, utilities, in an effort to shave demand peaks and otherwise smooth demand, may offer customers variable rate plans. Under these variable rate plans, a consumer may pay A cents per unit for energy at 10 AM, B cents per unit at 2 PM, and C cents per unit at 11 PM. Further, some utilities offer cost advantages to consumers who allow the energy provider to override their programmed thermostat settings at peak demand times to help prevent brownouts and blackouts.

These new pricing and control programs necessitate a communication link between the energy provider and the consumer's HVAC system, particularly the thermostat. This need for a communication link to the interior of a consumer's home presents two problems: first, traditional thermostats that use bimetal temperature sensors and mercury switches are incapable of accommodating digital communication. Second, a traditional heating, ventilation and air conditioning (HVAC) system includes only a few control wires. Conventional HVAC systems have only four wires running from the load devices, like the air compressor, furnace and air handler, to the thermostat. One wire is used for cooling control, one for heating control, one for fan control and one supplying an electrically isolated, 24-volt, class-II connection to the other three wires when the switches in the thermostat are closed. As such, even where a mechanical thermostat is replaced with an electronic one having a microprocessor capable of communicating with other devices, there is no suitable communication bus with which to connect an exterior data device with the thermostat.

One solution to this lack of a communication bus is to rewire a building with communication cables running from outside the building directly to the thermostat. This solution, however, is both time consuming and expensive. A technician must drill holes, fish cables, and install new power sources. Often this installation can be cost prohibitive for consumers.

An alternate solution is to equip a thermostat with a wireless communication system. The problem with this solution is that such a wireless connection requires more power than can be sourced by the 24-volt wire running to the thermostat. Consequently, additional wiring must still be provided to supply power to the communication device. Again, installation of additional wiring into existing structures may be cost prohibitive. While a battery may be used to power the wireless communication system, the user must take care to ensure that the batteries are continually replaced, which is inconvenient and costly. Further complicating matters, reception problems may exist with wireless systems due to interior walls and signal multipaths.

There is thus a need for an improved communication system suitable for retrofitting into conventional HVAC systems that both requires no additional wiring and is capable of operating from the 24-volt power wire without adversely affecting the operation of the HVAC system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
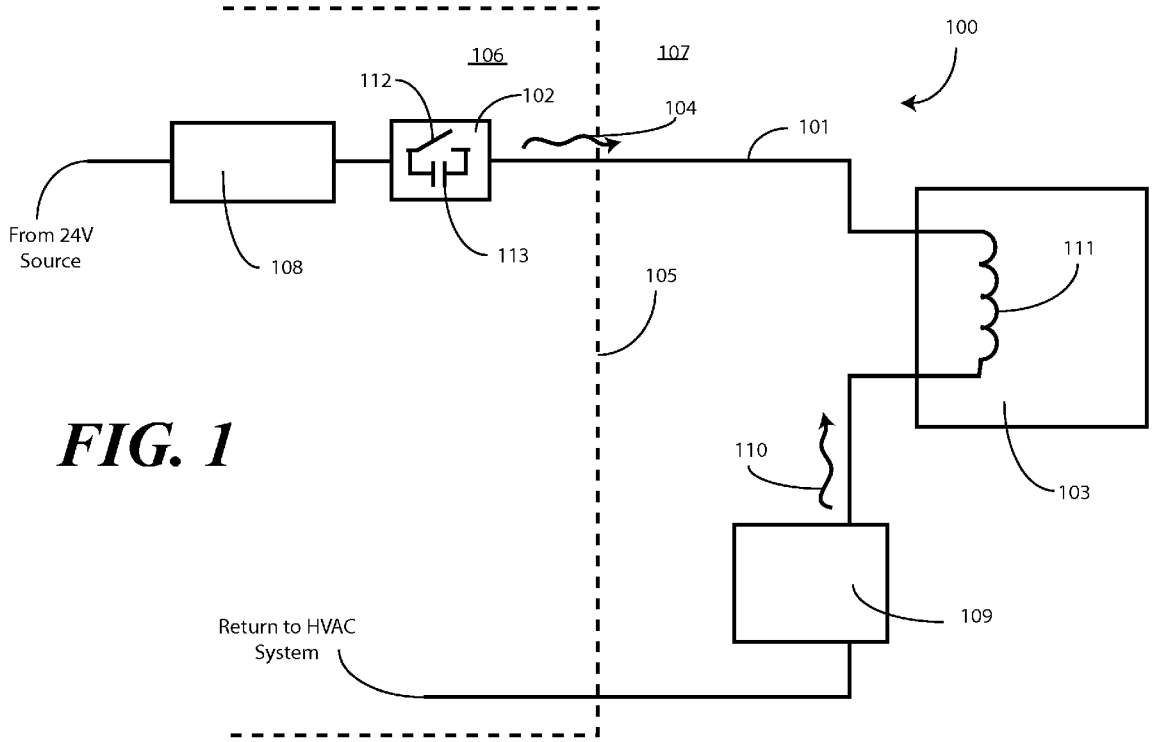
FIG. 1 illustrates a system for communication across HVAC wiring in accordance with the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations of method steps and apparatus components related to a communication system capable of operating with traditional HVAC wiring. The apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

It will be appreciated that embodiments of the invention described herein may be comprised of one or more conventional processors and unique stored program instructions that control the one or more processors to implement, in conjunction with certain non-processor circuits, some, most, or all of the functions of communication across conventional HVAC wiring described herein. The non-processor circuits may include, but are not limited to, signal transformers, radio-frequency modulators, signal drivers, clock circuits, power source circuits, and user input devices. As such, these functions may be interpreted as steps of a method to perform communication across HVAC wiring. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

The present invention offers a system and method for providing a reliable communication link between a HVAC control unit disposed within a building, like a thermostat for example, and a HVAC load disposed outside, like an air conditioning compressor for example. As noted above, conventional HVAC system wiring provides only a single wire from the thermostat to the compressor. In contrast to prior art communication systems that use differential voltage signals and multiple wire communication busses, the present invention uses high-frequency current modulation across this single wire to provide a communication channel from the interior to the exterior of the building. The present invention allows reliable, low-loss communication signals in excess of 4800 baud between thermostat, compressor or air handler as required.

In one embodiment of the invention, a current is injected into or induced upon the connection running between thermostat and compressor by way of a serially coupled, small signal transformer. The induced current is modulated with a RF signal. In one embodiment, the modulation signal has a frequency of between 5 and 50 MHz. In another exemplary embodiment, the frequency is 21.4 MHz, and the RF-modulated current signal is modulated by narrow band frequency shift keying (FSK) with a 4800-baud packet. The RF signal modulated onto the current waveform flows around the HVAC system in a continuous current loop. For example: a current induced on the compressor wire at the thermostat will flow along the wire to the coil winding of a contactor coupled to the compressor. As actuation transformers in load devices, like a contactor coil in an air compressor, can be quite large, the frequency of modulation is selected such that the signal flows through the parasitic inter-winding capacitance of the wire turns in the coil. By passing through the parasitic inter-winding capacitance, the RF signal modulated onto the induced current waveform is generally unfiltered and unaltered as it passes through the current loop.

After passing through the parasitic capacitance of the contactor coil, the signal is received by a second, serially coupled, small signal transformer in a receiver. The receiver, in one embodiment, is disposed outside the building and includes a narrow band RF receiver. As most conventional HVAC systems run in a continuous loop, the signal then continues to the class II, 24-volt system power transformer, which may be disposed at, near or in the air handler. Again, as with the compressor, the high-frequency signal is able to pass about the large inductance of the power transformer coil by coupling through the parasitic capacitance of the wire turns in the transformer. The signal then continues back to the communication module where it originated. Thus, a full loop is completed. While in one embodiment described below one communication device and one receiver are employed, it will be clear to one of ordinary skill in the art having the benefit of this disclosure that the invention is not so limited. Any number of communication devices and receivers may be coupled serially in the HVAC loop, regardless of location.

Turning now to FIG. 1, illustrated therein is one embodiment of a system 100 for communicating across a single HVAC control wire 101. For example, the system 100 may use the single wire 101 coupling a HVAC control unit 102, such as an electronic thermostat, with a HVAC load unit 103, such as an air compressor, to transmit communication signals 104 from inside 106 a building 105 to the exterior 107 of the building 105.

A communication device 108, suitable for connection to the HVAC control unit 102, is capable of inducing a modulated communication signal 104 onto any of the conventional wires coupling the control unit 102 with the load devices, e.g. 103. One wire that is of particular utility is the cooling control wire shown as element 101, as this wire 101 runs directly from the thermostat (disposed inside in conventional HVAC systems) to the air compressor (disposed outside in conventional HVAC systems). A receiver 109, which may be disposed near, in, or at the HVAC load unit 103, is capable of receiving the communication signal current 104.

In one embodiment, bi-directional communication between the communication device 108 and the receiver 109 is desirable. For instance, an energy provider may wish to retrieve demand or other data from the thermostat coupled to the communication device 108 while also uploading new pricing information. In such an embodiment, the receiver 109 is configured so as to be capable of inducing a second communication signal current waveform 110 onto the HVAC control wire 101, thereby acting as a transceiver. The first communication signal 104 transmits data from the communication device 108 to the receiver 109, while the second communication signal 110 transmits data from the receiver 109 to the communication device 108. In other words, both the communication device 108 and the receiver 109 may transmit and receive signals.

In one embodiment of the invention, the communication signals 104,110 comprise a frequency modulated current having a frequency of between 5 and 50 MHz. This frequency is selected such that the signals 104,110 are able to pass through large coils, e.g. contactor coil 111, in load devices, e.g. 103, by way of the inherent, parasitic capacitance formed by the closely wound wires in the coils (or transformer windings where present). The frequency selection allows the communication module 108 and receiver 109 to be placed at any point in the system, regardless of the location of transformers or other coils. For instance, in FIG. 1, the HVAC load unit 103 and its actuation contactor coil 111 are disposed serially between the communication module 108 and the receiver 109.

As one application for a communication system in accordance with the invention is retrieving and delivering information to and from an electronic thermostat in a HVAC system, quite often the communication device 108 will be directly coupled to the control unit 102 (i.e. the thermostat). Further, in HVAC systems, no matter where the communication module 108 is located, signals conducted across the control wire 101 will pass through the thermostat (since the control wire 101 and connecting paths run in a current loop). The thermostat will contain at least one HVAC load switch 112 capable of actuating the HVAC load unit 103 when closed. Additionally, there is a bypass capacitor 113 coupled in parallel with the switch 112. The communication device 108 transmits the signals 104,110 through this bypass capacitor when the switch 112 is open. When the switch 112 is closed, the 24-volt source is coupled in parallel with the bypass capacitor 113 (effectively shorting the capacitor 113) to the HVAC control wire 101. The closed switch 112 thereby delivers a high-current control signal to the HVAC control wire 101 to actuate the HVAC load unit 102.

As such, when the switch 112 is open, the communication device 108 must ensure that the power of the signals 104,110 is not large enough to actuate the HVAC load unit 102. In other words, the power of the signals 104,110 must be limited so as not to inadvertently cause the HVAC load unit to inadvertently turn on. Thus, in one embodiment of the invention, the communication signals 104,110 comprise a frequency modulated signal imposed on a current waveform having a peak value that remains below a predetermined switch threshold, the predetermined switch threshold corresponding to a level capable of actuating a HVAC load switch in the HVAC control unit.

Note that in the exemplary embodiment of FIG. 1, the control unit 102 has been described as a thermostat, and the HVAC load unit 103 has been described as an air compressor. It will be clear to those of ordinary skill in the art having the benefit of this disclosure, however, that the invention is not so limited. The control unit 102 may be any type of device capable of affecting the performance of the overall HVAC system. One example would be a smoke detector that, for instance, turns off the furnace when smoke is detected. Additionally, the HVAC load device 103 may be any of an air conditioning compressor, a compressor, an air handler, heat pump, humidifier, furnace, or other devices. Further, the communication system could be used to control these devices.

Figure 2:
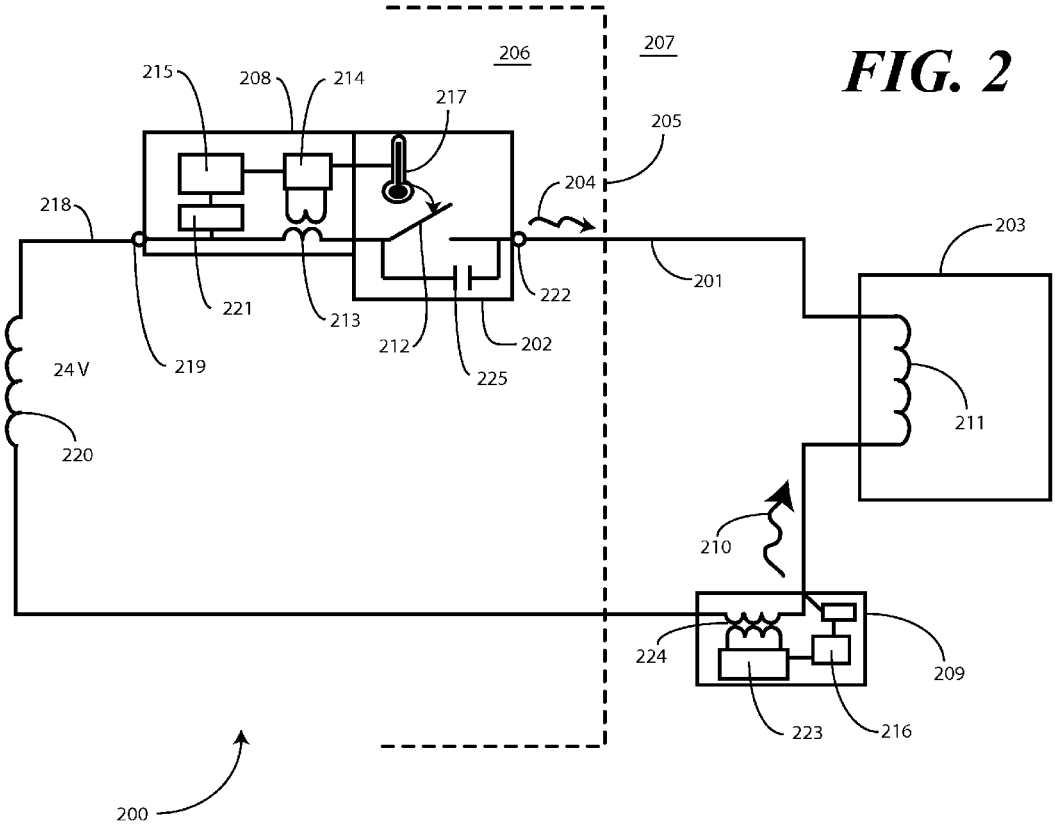
FIG. 2 illustrates an alternate embodiment of a system for communication across HVAC wiring in accordance with the invention.

Turning now to FIG. 2, illustrated therein is another embodiment of a HVAC communication system 200 in accordance with the invention. The system 200 includes a communication device 208 suitable for coupling to an electronic thermostat 202. The electronic thermostat 202 has four contacts suitable for coupling to conventional HVAC wiring (i.e. a low-voltage power wire, a heating control wire, a cooling control wire and a fan control wire).

The communication device 208 includes a control module 215 and a communication module 208 coupled to the control module 215. In one embodiment, the control module 215 comprises a microprocessor capable of executing instructions from an embedded code. The control module 215 serves as the central processing unit in the operation of the communication device 208. The control module 215 is coupled to the thermostat 202 so as to be able to transmit and receive data from data circuitry in the thermostat 202.

The communication module 208 is configured to communicate through the HVAC system by way of a small signal communication transformer 213 coupled serially with a control wire 201 running from the thermostat 202 to a load 203. While the control wire 201 may be any of the heating control wire, fan control wire or cooling control wire, for simplicity of discussion the control wire 201 shown in FIG. 2 is chosen to be the cooling control wire, which is a single wire running from a control terminal 222 of the thermostat 202 to a contactor coil 211 or other device disposed within the load 203. This will be a preferred selection of many installations, as the air compressor 203 is disposed outside 207 a building 205, while the thermostat 202 is disposed inside 206.

The compressor 203, in conventional systems, includes a contactor coil 211 with which the thermostat 202 turns on the air conditioning system. Per the discussion above, to take advantage of inherent capacitances in the windings of this contactor coil 211, the frequency of the communication signal 204 is selected so as to easily be transferred across the parasitic capacitances of the transformer or coil windings. In one embodiment, the signal 204 has a frequency of between 4 and 50 MHz.

To induce current signals onto the control wire 201, the communication module 214 includes a communication transformer 213 that is coupled serially between the control module 215 and the air compressor 203. Radio frequency communication circuitry 214 disposed within the communication module 214 induces low-power current signals 204,210 into the control wire 201 by way of the communication transformer 213. By modulating the control wire 201 with a low-power signal, digital control and data communication signals may be transmitted from the thermostat 202 to a receiver 209 and vice versa.

In the exemplary embodiment of FIG. 2, the system 200 includes a thermal sensing element 217 coupled to the control module 215. The thermal sensing element 217 may be the temperature sensor residing in the thermostat 202. The system 200 also includes at least one switch 212 responsive to the thermal sensing element 217. The switch 212 may be any of the heating control switch, the fan control switch and the cooling control switch found in a conventional thermostat. Alternatively, the communication device 208 itself may include a serially coupled switch (not shown) that would, in effect, override the thermostat switches. In the embodiment of FIG. 2, the switch 212 is the cooling control switch of the thermostat 202. When the switch 212 is closed, the switch 212 actuates the load 203. Note that there is a bypass capacitor disposed about the switch that the communication device 208 employs for communication when the switch 212 is open. Thus, an AC loop for communication exists regardless of the state of switch 212. Further, where the communication device 208 includes an override switch, a parallel bypass capacitor would be included about that switch as well.

Note that the low-voltage AC terminal is also coupled to the control module 215 by way of a power supply module 221. This is done so that the control module may operate in a "parasitic power" mode, wherein all power needed to operate the communication device 208 may be drawn from the low-voltage AC terminal 219. In other words, a power supply module 221 is coupled to the low-voltage AC input terminal 219, and the power supply module 221 receives an amount of power from the low-voltage AC input terminal 219 sufficient to operate the control module 215 and the communication module 214. Such operation provides unique advantage in that no batteries or other power connections are required when installing the communication device 208 into a conventional HVAC system.

To be able to operate in a parasitic power mode, however, the control module 215 must take care not to draw so much power for the operation of the communication device 208 that the power supply transformer 220 becomes overloaded, thereby causing the 24V output voltage to droop. As such, the power drawn by the communication device 208 must remain below a predetermined threshold. Experimental results have shown that so long as the components of the communication device 208 draw no more than 55 mW, operation of most HVAC systems will not be affected by the presence of the communication device 208. As such, in accordance with one embodiment of the invention, the total power drawn by the power supply module 221 for its operation and the operation of the control module 215 and communication module 214 remains below a predetermined threshold. In one embodiment, this predetermined threshold is 48 mW. Experimental testing has shown, however, that a predetermined threshold of 55 mW works in most all applications.

A second communication device 209 is provided for receiving signals 204 from the communication device 208. The second communication device 209 includes a second control module 216 and a second communication module 223 having a second communication transformer 224 coupled serially with the control wire 201. The second communication device 209 acts as a receiver for signals 204 sent by the communication device 208, and is also capable of transmitting signals 210 to the communication device 208. As such, when the control module 215 actuates the communication module 214, a communication signal 204 is transmitted across the control wire 201 and is received by the second communication module 209, and vice versa.

Figure 3:
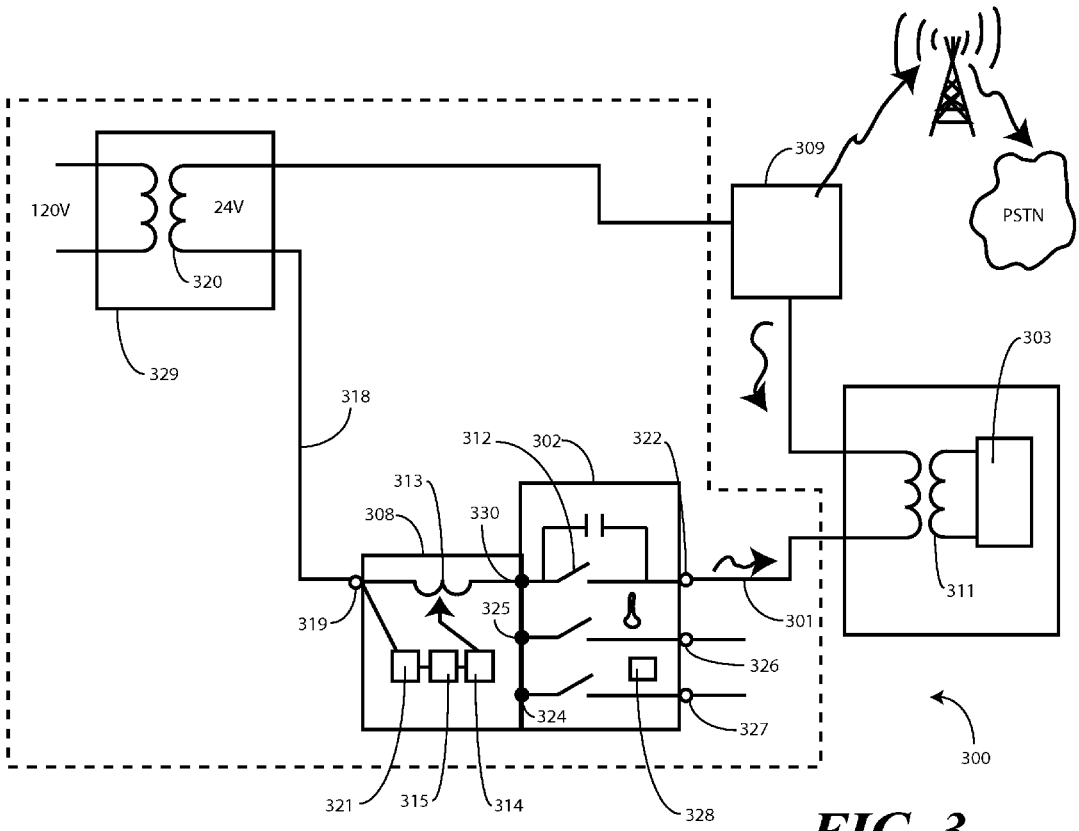
FIG. 3 illustrates an alternate embodiment of a system for communication across HVAC wiring in accordance with the invention.

Turning now to FIG. 3, illustrated therein is another embodiment of a communication system 300 for conventional HVAC wiring in accordance with the invention. A communication device 308 has a plurality of terminals 319, 330,324,325 configured to couple to a plurality of HVAC control wires 301,318,326,327, either directly or through a thermostat 302 to which the communication device 308 is coupled. One of the terminals is a low-voltage AC terminal 319 that is coupled to a power transformer 320, such as the class II, 24V transformers found in conventional HVAC systems. Another terminal is a Y-line terminal 322. The Y-line terminal 322 is so called because in certain regions of the United States, a yellow wire is used as the cooling control wire 301 that runs directly from the thermostat to the air compressor 303 of the air conditioning system. As the "yellow line" or "Y-line" and "Y-terminal" are recognized terms in the industry, they are used herein to refer to this control wire 301. It is not intended that yellow be a limiting adjective in referring to this control wire 301, rather it is simply a commonly used term to easily identify this control wire 301. It will be clear to those of ordinary skill in the art that any color wire may be used. In fact, some areas of the country employ a blue color for this control wire 301.

A power supply 321 is coupled to the low-voltage AC input terminal 319 for providing power to the communication device 308. In the embodiment of FIG. 3, all power required to operate the communication device 308 is drawn from this low-voltage AC input terminal, thereby allowing the device 308 to operate as a parasitic power device, where no external batteries or additional power sources are required. A control module 315 is coupled to the power supply 321. As with the embodiment of FIG. 2, the control module 315, which may be a microprocessor or programmable logic device, serves as the central processor of the device 308.

So that the air compressor 303 may be turned on, at least one switch 312 is coupled to and controllable by the control module 315. When the switch 312 is closed, the low voltage AC terminal 319 is directly coupled to the Y-line terminal, such that the low voltge, 24-volt, AC input on the low-voltage AC power line 318 is passed through to the contactor coil 311 coupled to the air compressor 303. In other words, when the switch 312 is closed, power sufficient to actuate the air compressor is passed to the load, thereby causing it to actuate. It can be seen in FIG. 3 that the Y-line 301 effectively makes an AC loop throughout the system 300 regardless of the state of switch 312, thereby permitting the communication module 314 to communicate at all times. The Y-line 301 runs from thermostat to the air compressor load 303 to the air handler 329 and back to the thermostat 302.

As with the embodiment of FIG. 2, a communication module 314 is coupled to the control module 315 between the compressor 303 and the air handler 329. The control module 315 delivers data to the communication module 314, which in turn transmits the data by inducing a RF signal onto the Y-line 301 by way of a communication transformer 313 coupled to the communication module 314. One winding of the communication transformer 313 is coupled serially with the Y-line terminal 322.

The communication module 314 includes circuitry configured to couple a communication signal to the communication transformer 313. As noted above, in one embodiment, the communication module may modulate the communication signal with a carrier signal having a frequency of between 5 and 50 MHz. The frequency should be high enough so as to take advantage of the parasitic capacitance found in the transformer or coil windings of the load devices, but should not be so high as to create electromagnetic noise for surrounding systems. Since the Y-line 301 is coupled in a large loop about the HVAC system, it can act as a large antenna, thereby broadcasting certain signals to neighboring systems. Experimental results have shown that frequencies of between 8 and 12 MHz, between 18 and 25 MHz and between 44 and 46 MHz work well in providing signals with minimal loss across the HVAC system. One frequency well suited for easy manufacture of the RF circuitry in the communication module 314 is 21.4 MHz.

In the embodiment of FIG. 3, the communication device 308 is coupled to an electronic thermostat 302. The communication device 314 may in fact be disposed within a sub-base of the thermostat 302. In such an embodiment, the communication device 308 may be used to retrieve information from the thermostat 302 and to transmit it to, for example, an energy provider. The communication device 308 may also receive one or more signals from the energy provider. The control module 315 of the communication device 308 may therefore include a memory device for storing the information retrieved from the thermostat. The information monitored by the communication device 308 may include operating characteristics of the thermostat such as total compressor usage, total furnace usage, total HVAC system usage, average compressor usage, average furnace usage, average HVAC system usage, peak compressor usage, peak furnace usage, peak HVAC system usage, time of compressor usage, time of furnace usage, time of HVAC system usage, cost of compressor usage, cost of furnace usage, cost of HVAC system usage, time of use schedule, temperature override information, hold override information, time of day information, diagnostic information, error messages, temperature profiling information, appliance control schedules, protocol handling messages, current HVAC operating modes, thermostat configuration flags, test commands and lockout commands.

Additionally, information about and/or relating to appliances connected to the HVAC system, like the air handler, compressor, furnace or heat pump for instance, may be communicated across the HVAC system by the communication device 308. The communication device 308 may further communicate to the thermostat 302 information from an energy provider such as an energy rate or an override request. The thermostat 302 may communicate to the communication device 308 information including a command signal for actuating the load, e.g. 303, and temperature set point information.

It will be clear to those of ordinary skill in the art having the benefit of this disclosure that other devices, in addition to thermostats, may be coupled to the communication device 308. For instance, an environmental sensor 328 like a smoke detector, hygrometer, motion sensor or other device may also be coupled to the communication device 308. As such, the communication device may be configured to monitor changes in environmental conditions such as temperature, humidity, smoke, light, audio, water level, weight, motion, pressure, electrical current, voltage, AC input frequency and chemical element presence. Where the change in environmental condition exceeded a predetermined threshold, the control module 315 may actuate the communication module 314. By way of example, where the environmental sensor 328 is a smoke detector, the communication device 308 may transmit a signal across the Y-line 301 out of the house to a receiver 309. The receiver 309 would then be able to notify the proper emergency personnel.

As with FIG. 2, a second communication device, or receiver 309, is coupled serially with the Y-line 301. The receiver 309 is capable of detecting and receiving communication signals from the communication device 308. Further, in bi-directional systems, the receiver 309 may operate as a transmitter by inducing modulated current into the Y-line as well.

As noted above, since the Y-line effectively forms a large loop within the structure, in one embodiment of the invention, the communication device 308 and receiver 309 are capable of handshaking to determine the proper amount of power with which to transmit communication signals. It is often desirable to transmit with the smallest amount of power that will reliably deliver data from transmitting module to receiving module. To do this, at least one of the communication module 308 and the receiver 309 may be configured to transmit a signal to the other. In response to receiving the signal, the receiving device may transmit a received signal strength to the transmitting device. Upon receiving the received signal strength, the sending device may then compare this strength with a minimum threshold to determine whether the transmission power should be increased or decreased.

By way of example, the communication module 308 may transmit a message (which may include signal strength information) to the receiver 309, which is the second communication device in the system 300. The communication module 308 may retrieve a received signal strength from the receiver 309. Where the received signal strength is below a predetermined threshold, the communication device may increase the transmitted signal strength. Where the received signal strength is above a predetermined threshold, the communication device may decrease the transmitted signal strength.

As also noted above, it may be useful for an energy provider to take advantage of the communication device to upload information to devices coupled to the HVAC system. For example, in volatile energy markets, the energy provider may wish to transmit pricing data to the thermostat 302. The user, in an effort to save heating and cooling costs, may wish to program his thermostat to run the HVAC system when the cost of energy is below a particular price point, and to not run the HVAC system when the cost of energy is above a particular price. As such, the receiver 309 may be equipped with wired or wireless communication equipment so as to communicate with a wireless wide area network, like a cellular communications network, or with a local area network or public switched telephone network, or other equivalent, like a cable television or broadband network. Where this is the case, the energy provider may call the receiver 309 and transmit data thereto. The receiver 309 may then transmit the information to the communication device 308, which in turn uploads the information to the thermostat 302. Where the receiver 309 is configured to receive energy consumption information from an energy provider and to communicate the energy consumption information across the Y-line 301 to the communication module 308, the thermostat 302 may act on that information. For instance, when the energy consumption information matches a predetermined criterion, such as a specific price point, the control module may cause the switch 312 to open or close, depending upon whether the user wants the HVAC system to be operational given the delivered energy consumption information.

One suitable device, among others, for use as the second communication device is a Digital Control Unit (DCU) box manufactured by Comverge, Inc. The DCU box is designed to be coupled outside near the air compressor. The DCU box may be employed for communication through various channels, including through wide area and local area networks to an energy provider.

Figure 4:
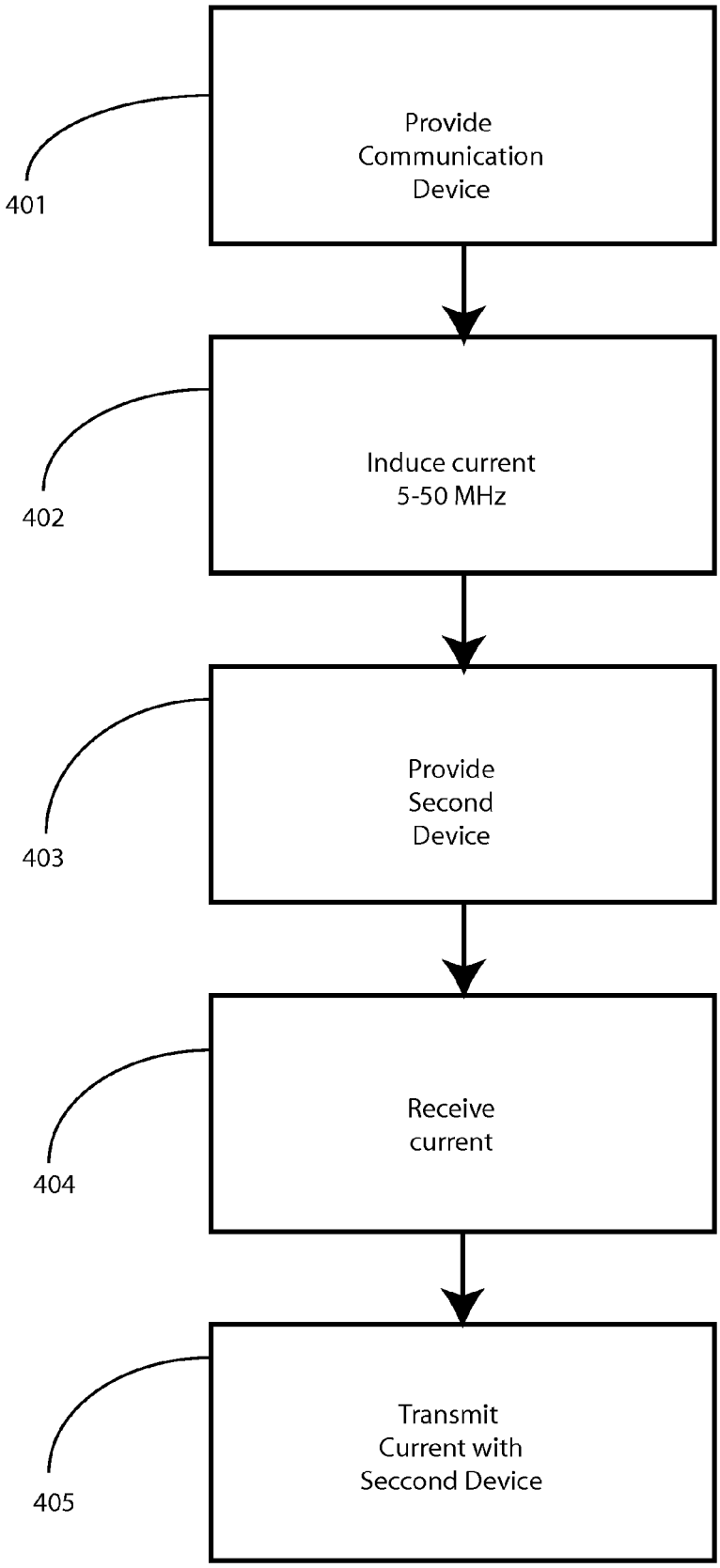
FIG. 4 illustrates a method of communication across HVAC wiring in accordance with the invention.

Turning now to FIG. 4, illustrated therein is a method of communicating across an HVAC system in accordance with the invention. The system and apparatus elements associated with execution of the method have largely been described in the discussion above. At step 401, a communication device is provided by coupling the device serially with at least one wire of the HVAC system. At step 402, a current is induced in the one wire. In one embodiment, the current comprises an AC current having a frequency of between 5 and 50 MHz. In another embodiment, the frequency is between 8 and 46 MHz. Testing has shown 21.4 MHz to work well with minimal signal loss across a wide variety of HVAC systems.

At step 403, a second communication device is provided by coupling the second communication device serially with the one wire of the HVAC system. In uni-directional systems, the second communication device operates as a pure receiver for signals transmitted by the communication device. In bi-directional systems, the second communication device may operate as both receiver and transmitter.

Assuming a bi-directional system, at step 404, the second communication device receives the current transmitted by the communication device. At step 405, the second communication device induces a current in the at least one wire, thereby being able to transmit messages to the communication device.

To recap, the present invention allows a low-power, parasitic power communication device to be used in conjunction with HVAC control devices, like electronic thermostats. The invention may be retrofitted in existing structures with conventional HVAC wiring systems, including those with only four wires: one supplying a 24-volt power source, one for heating control, one for cooling control. (Likewise, the invention may be retrofitted into electric heat pump systems, which traditionally have 5-8 wires for operation, without the need to install additional wires for either power or communication from the communication device.) The communication device operates by inducing RF modulated current signals in to the Y-line that runs from the thermostat to the load. The load of choice is often the air compressor because it is disposed outside of the building in which the HVAC system resides.

In one embodiment, the system includes at least one HVAC load, an air handler coupled to the HVAC load and the communication device coupled between the HVAC load and the air handler. The communication device comprises an input terminal electrically coupled to the air handler for receiving a 24-volt power connection and a Y-terminal electrically coupled to the HVAC load. A power supply module disposed within the communication device is coupled to the input terminal and a communication module is coupled to the power supply module. A signal transformer is coupled to the communication module. One winding of the first signal transformer is coupled serially with the Y-terminal. A switch, either in the thermostat or the control module, when closed, actuates the load.

A second communication device having a second signal transformer coupled serially with the Y-terminal and a second communication module coupled to the second signal transformer operates as a transceiver for sending and receiving signals to and from the first communication device. The first and second communication devices are therefore able to communicate across the Y-line by transmitting or inducing low power, high frequency current signals. These signals may be imparted upon current waveforms already being conducted by the Y-line.

The current modulation across the single-wire Y-line offers several advantages over the prior art. To begin, multiple wire communication busses are not required to transmit information from inside a building to its exterior. Second, the low-power signals allow the communication module to still operate in a parasitic power mode, without the need for external batteries or additional power sources.

Figure 5:
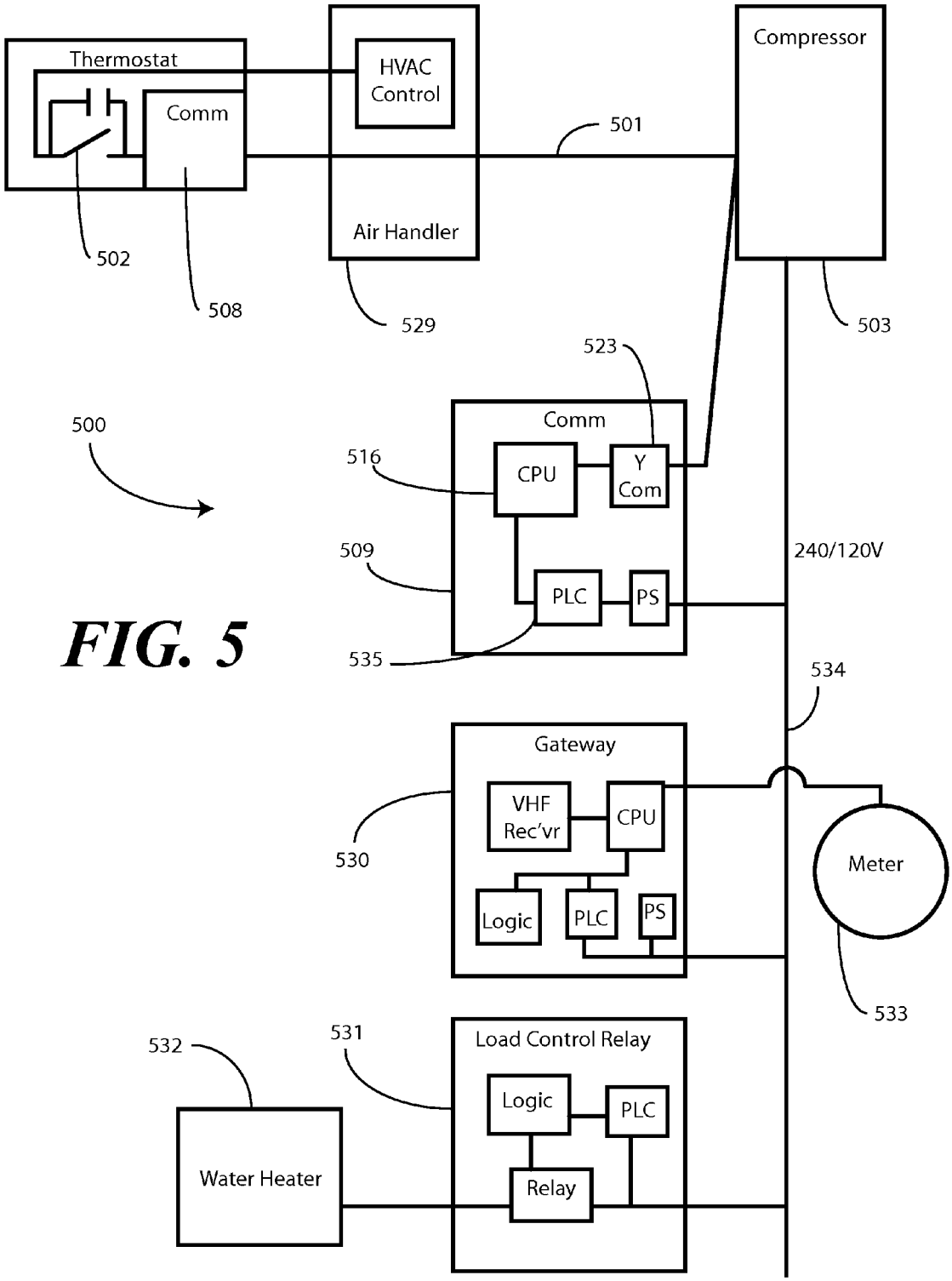
FIG. 5 illustrates a system for communication across a HVAC wiring, the system being equipped with PLC communication capability, in accordance with the invention.

While communication across the Y-line from inside a building to a second communication device located outside has been described herein, it will be clear to those of ordinary skill in the art having the benefit of this disclosure that the invention is not so limited. For example in addition to including RF circuitry for transmitting high frequency current across the Y-line, the communication module may also be configured with Powerline Carrier (PLC) circuitry so as to communicate across a building's 240/120 volt wiring within the home. In so doing, information could be transmitted to and from appliances and other devices via PLC communication to the communication device, and then to and from the second communication device along the Y-line. FIG. 5 illustrates such a system.

Turning to FIG. 5, illustrated therein is an integration of a communication device in accordance with the invention with other devices via PLC communication. A thermostat 502 is connected to the system 500 using normal thermostat wiring. As noted above, the thermostat 502 is often connected to an air handler 529 located near the furnace. Coming from the air handler 529 through the thermostat 502, the Y-line 501 runs to a compressor 503 disposed outside the building.

With no additional wiring, a communication module 508 may be coupled to the Y-line for facilitating communication to a second communication module 509 disposed outside the building. The second communication module 509, having a control module 516 and communication module 523 disposed therein, may be fitted with PLC communication circuitry 535 so as to communicate through the 240/120 volt wiring 534 of the building. The communication module 508 and second communication module 509 may thus work in tandem to communicate with other devices coupled to the electrical wiring 534, including the meter 533, load control relays 531, a gateway 530 and appliances like a water heater 532. Once in place, the communication system 500 can also be used to network the thermostat 502 onto a communication bus, e.g. 534. Such a bus, which may also be wireless, can be used to send diagnostics to local or remote users.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims.

Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A communication system, the communication system comprising:

a. a communication device comprising a plurality of terminals configured to couple to a plurality of HVAC control wires, the plurality of terminals comprising at least a low-voltage AC input terminal and a Y-line terminal;

b. a power supply coupled to the low-voltage AC input terminal, wherein power required to operate the communication system is drawn from the low-voltage AC input terminal;

c. a control module coupled to the power supply;

d. at least one switch coupled to the control module, wherein when the at least one switch is coupled between the low-voltage AC input terminal and the Y-line terminal;

e. a communication module coupled to the control module; and f. a communication transformer coupled to the communication module, wherein a winding of the communication transformer is coupled serially with the Y-line terminal.

2. The communication system of claim 1, wherein the communication module comprises circuitry configured to couple a communication signal to the communication transformer, wherein the communication signal comprises a carrier signal having a frequency of between 5 and 50 MHz.

3. The communication system of claim 2, wherein the carrier signal has a frequency selected from the group consisting of between 8 and 12 MHz, between 18 and 25 MHz and between 44 and 46 MHz.

4. The communication system of claim 1, wherein the communication device is capable of coupling to a thermostat, further wherein the control module is configured to monitor operating characteristics of the thermostat, wherein the operating characteristics are selected from the group comprising total compressor usage, total furnace usage, total HVAC system usage, average compressor usage, average furnace usage, average HVAC system usage, peak compressor usage, peak furnace usage, peak HVAC system usage, time of compressor usage, time of furnace usage, time of HVAC system usage, cost of compressor usage, cost of furnace usage, cost of HVAC system usage, time of use schedule, temperature override information, hold override information, time of day information, diagnostic information, error messages, temperature profiling information, appliance control schedules, protocol handling messages, current HVAC operating modes, thermostat configuration flags, test commands and lockout commands.

5. The communication system of claim 1, further comprising an environmental sensor coupled to the control module, wherein the environmental sensor senses a change in environmental condition selected from the group consisting of temperature, humidity, smoke, light, audio, water level, weight, motion, pressure, electrical current, voltage, AC input frequency and chemical element presence, further wherein when the change in environmental condition exceeds a predetermined threshold, the control module actuates the communication module.

* * * * *